US006394761B1

(12) United States Patent
Hirota

(10) Patent No.: US 6,394,761 B1
(45) Date of Patent: May 28, 2002

(54) CAPACITY CONTROLLER OF CAPACITY VARIABLE COMPRESSOR

(75) Inventor: Hisatoshi Hirota, Tokyo (JP)

(73) Assignee: TGK Co., Inc., Tokyo (JP)

( * ) Notice: Subject to any disclaimer, the term of this patent is extended or adjusted under 35 U.S.C. 154(b) by 0 days.

(21) Appl. No.: 09/543,537

(22) Filed: Apr. 5, 2000

(30) Foreign Application Priority Data

Apr. 27, 1999 (JP) ..... 11-118986

(51) Int. Cl.[7] ..... F04B 1/26
(52) U.S. Cl. ..... 417/222.2; 417/222.1
(58) Field of Search ..... 417/222.1, 222.2

(56) References Cited

U.S. PATENT DOCUMENTS

| | | | | |
|---|---|---|---|---|
| 4,702,677 A | | 10/1987 | Takenaka et al. | 417/222 |
| 4,875,832 A | * | 10/1989 | Suzuki et al. | 417/222 |
| 4,932,843 A | * | 6/1990 | Itoigawa et al. | 417/222 |
| 4,936,752 A | * | 6/1990 | Terauchi | 417/222 |
| 5,165,863 A | * | 11/1992 | Taguchi | 417/222.2 |
| 5,332,365 A | * | 7/1994 | Taguchi | 417/222.2 |
| 5,681,150 A | * | 10/1997 | Kawaguchi et al. | 417/222.2 |

FOREIGN PATENT DOCUMENTS

| | | | | |
|---|---|---|---|---|
| EP | 0 498 552 | | 8/1992 | |
| EP | 0 854 288 | | 7/1998 | |
| JP | 166086 A | * | 6/1997 | F04B/49/08 |

* cited by examiner

*Primary Examiner*—Charles G. Freay
*Assistant Examiner*—Timothy P. Solak
(74) *Attorney, Agent, or Firm*—Nilles & Nilles, S.C.

(57) ABSTRACT

In a capacity control apparatus of a variable capacity compressor 10 a chamber 30 between a valve seat 26 and diaphragm 24 communicates with a pressure control chamber 12 of the compressor 10. Said valve seat 26 communicates outside said chamber 30 with an inhalation chamber 3 of said compressor. A valve element 25 which is pressure balanced in relation to the pressure Pc in pressure control chamber 12 is axially moveable within said chamber 30. The pressure effective areas of said valve seat 26 and of a diaphragm 24 co-acting with said valve element 25 are formed with equal sizes. Due to the relatively small diaphragm size a small sized and cheap solenoid can be used for the actuation of valve element 25. The cross-section area of valve seat 26 is relatively big and prevents a delayed control response behavior of the capacity control apparatus.

2 Claims, 2 Drawing Sheets

CAPACITY CONTROLLER OF CAPACITY VARIABLE COMPRESSOR

BACKGROUND OF THE INVENTION

The present invention relates to a capacity control apparatus for use in co-operation with compressor in a refrigerating cycle of an automobile air-conditioner or the like.

As the compressor in the refrigerating cycle of an automobile air-conditioning system directly is driven from the engine via a belt, the individual speed of the compressor cannot be controlled. In order to obtain proper refrigerating ability without limitation by engine speed, a compressor is used, the capacity of which (the amount of discharged refrigerant) can be varied independent from the compressor speed. Conventional compressors are of the inclined board type, rotary type or a scroll type, or of other types. An inclined board type compressor has a crank chamber serving as a pressure control room for controlling the capacity. The interior pressure of said pressure control chamber affects the initial capacity of the compressor. The capacity is changed by automatically controlling a control pressure (Pc) in the crank chamber corresponding to variations of an inhalation pressure (Ps) of the compressor. In the capacity control apparatus a pressure control valve serves to open or close a flow passage between the crank chamber (pressure control chamber) and an inhalation chamber of the compressor. Said valve opens and closes corresponding to variations of the inhalation pressure. In closing direction the pressure of the ambient air is active in combination with an energisation force adjusted by a solenoid. Said forces are transmitted in opening direction via a diaphragm onto which also the inhalation pressure is acting. Said pressure control valve opens and closes and thus varies the level of the pressure in the crank chamber. A chamber within the pressure control valve defined between a valve seat and said diaphragm communicates with said pressure control chamber. The other side of said valve seat communicates with the inhalation chamber. Control pressure (Pc) in said crank chamber should not affect the balance of said pressure control valve in order to control the capacity correctly. For that reason the pressure effective area of said diaphragm has to be dined much larger than the pressure effective area within said valve seat. If the pressure effective area of said diaphragm is large, the solenoid adjusting the energisation force for the pressure control valve also has to be large and heavy resulting in an undesirable large size of the apparatus and high costs. If the pressure effective area within said valve seat is reduced, the throttling effect of the refrigerant flow through said valve seat is significant, resulting in an undesirably delayed response behavior of the capacity control apparatus.

OBJECTS AND SUMMARY OF THE INVENTION

It is an object of the invention to provide a capacity control apparatus having small size which can be produced with fair costs.

Due to at least essentially equal pressure effective sizes of the areas on the diaphragm and inside the valve seat the control pressure (Pc) in the pressure control chamber or crank chamber does not affect the balance of opening and closing strokes in the pressure control valve chamber. Said valve seat communicates outside said chamber with the inhalation room. A small sized pressure effective area of the diaphragm suffices for a proper control function. As a consequence, said small sized pressure effective area of the diaphragm allows to use a small sized and cheap solenoid. Since there is no need to use a small sized pressure effective area for said valve seat but instead the same pressure effective area than the pressure effective area of said diaphragm can be used. As a result, the response behavior of capacity control is not delayed during e.g. an opening stroke of the pressure control valve. The control behavior of the pressure control valve is stable. It is not necessary to restrict the flow between the inhalation chamber and the crank chamber by a small cross-section in the passage at the valve seat.

BRIEF DESCRIPTION OF THE DRAWINGS

An embodiment of the invention will be described with the help of the drawings. In the drawings is.

DESCRIPTION OF THE PREFERRED EMBODIMENTS

Figure 1:
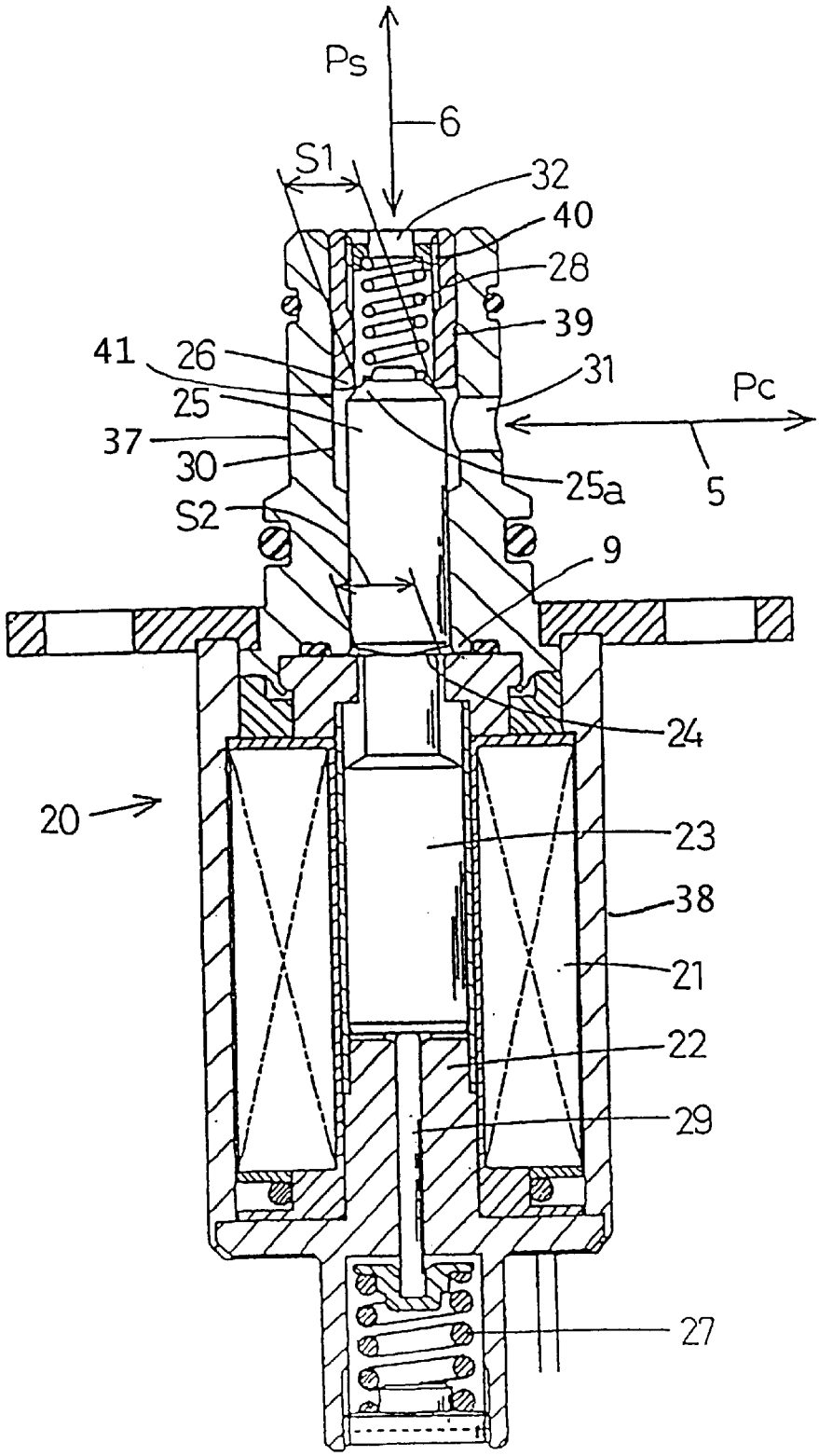
FIG. 1 an axial sectional view of a pressure control valve of a capacity control apparatus, and FIG. 2 a schematic view, partially in the form of sections, of a portion of a refrigerating cycle.

In FIG. 1 a pressure control valve 20 of a capacity control apparatus of an automobile refrigeration cycle (FIG. 2) is shown. It comprises a housing 37 with an inner stepped bore 41 defining a chamber 30 and comprises a casing 38 receiving a solenoid (magnetic coil 21, fixed iron core 22, moveable iron core 23). Casing 38 is connected with housing 37. A diaphragm 24 is stationarily secured at a circular shoulder 9 of a central casing bore having an inner diameter S2. S2 is defining the pressure effective area of diaphragm 24. Diaphragm 24, at its lower surface in FIG. 1, can be acted upon by the pressure of ambient air. Diaphragm 24 serves to separate the inner space of casing 38 from chamber 30. Diaphragm 24 is made impermeable. An upper actuation end of moveable iron core 23 abuts said lower surface of diaphragm 24. A compression coil spring 27 in a lower chamber of casing 38, the force of which can be adjusted, is biasing moveable iron core 23 upwardly. The force of said compression coil spring 27 is transmitted onto moveable iron core 23 via rod 29 extending through a central bore of fixed iron core 22.

As soon as magnetic coil 21 is supplied with current, moveable iron core 23 is attracted by fixed iron core 22 by a force acting opposite to the force of compression coil spring 27. The value of the current supplied to magnetic coil 21 is decisive for the resulting force acting on the lower surface of diaphragm 24.

Within bore 41 and chamber 30 an axially moveable valve element 25 of generally cylindrical shape, is provided. Said valve element 25 is formed pillared. Valve element 25 is guided with radial clearance within bore 41. Its lower, convex end abuts the upper surface of diaphragm 24. Valve element 25 is formed with a frustoconical closure part 25*a* co-acting with a valve seat 26. Valve seat 26 in this embodiment is constituted by a circular inner edge of a sleeve 39 inserted into the tipper end of chamber 30. Sleeve 39 receives an axially adjustable adjust screw 40 for a second compression coil spring 28 biasing valve element 25 in a direction opposite to the direction of the force of first compression coil spring 27. Springs 27 and 28 are pressure control springs.

In a side wall of housing 37 a crank chamber connecting port 31 is provided which opens in the side wall of chamber 30. Port 31 is connected to a crank chamber duct 5 (control pressure Pc). At the outer end of sleeve 39 an axial inhalation chamber connecting port 32 is formed which is connected to an inhalation duct 6 (inhalation pressure Ps). Valve seat 26 is defining a pressure effective area for valve element 25. Said pressure effective area SI has the same size as pressure effective area S2 of diaphragm 24 (S1=S2). For that reason, control pressure PC in chamber 30 is pressure balanced for valve element 25 and does affect opening or closing strokes of valve element 25. However, inhalation pressure Ps on pressure effective area S1 is acting on valve element 25 in the same direction as compression coil spring 28, namely opposite to the energisation force generated by compression spring 27 minus the attraction force for moveable iron core 23 plus the force created by the pressure of the ambient air at the lower surface of diaphragm 24. Inside chamber 30 also pressure Pc is acting on the pressure effective area S2 of diaphragm 24 in the same direction as pressure Ps and the force of compression coil spring 28. In other words, the pressure of the ambient air and the resulting energisation force from compression coil spring 27 and the attraction force of moveable iron core 23 is acting via diaphragm 24 onto valve element 25 in closing direction towards valve seat 26, while inhalation pressure Ps, the force of spring 28 are acting in opening direction on valve element 25. In opening direction also pressure Pc may be effective on diaphragm 24.

Figure 2:
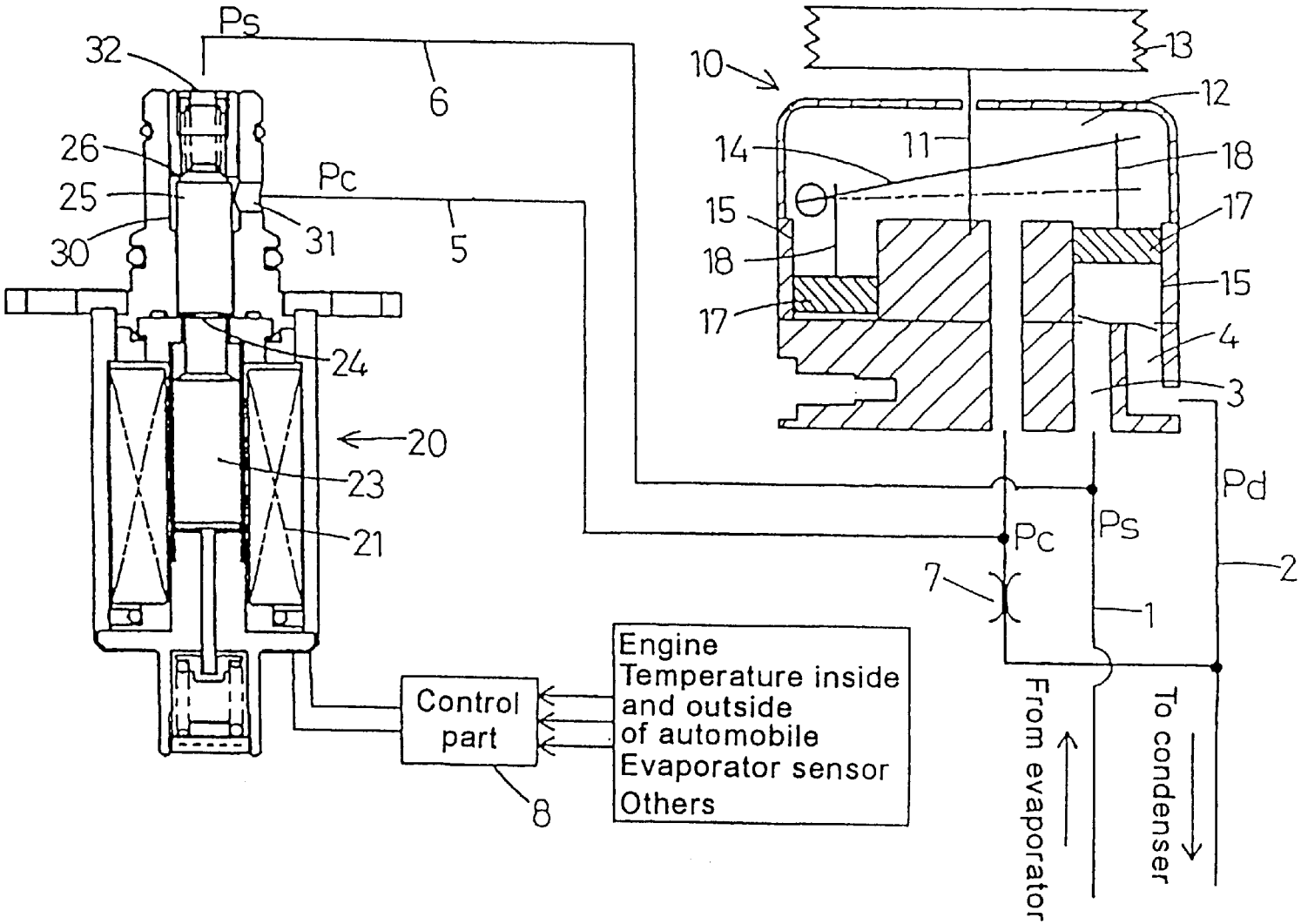

FIG. 2 illustrates said pressure control valve 20 integrated into an automobile air-conditioning system comprising a capacity variable compressor 10 of the inclined plate type. In airtight crank chamber 12 of compressor 10 a rotary shaft 11 is disposed driven by a pulley 13 via a belt. A plate 14 is associated to the rotary shaft 11 in crank chamber 12. The inclination of plate 14 can be adjusted in relation to the axis of rotary shaft 11 between a position, where plate 14 is essentially perpendicular to rotary shaft 11 (minimum capacity) and an inclined position in which plate 14 includes an angle with the axis of rotary shaft 11 smaller than 90° (maximum capacity). The inclination of plate 14 can be adjusted gradually between maximum capacity and minimum capacity. As soon as rotary shaft 11 rotates plate 14 fulfils a rocking motion the stroke extent of which depends on the chosen inclination.

In at least one cylinder 15 sidewardly arranged within crank chamber 12 a piston 17 is disposed reciprocally. Piston 17 is connected by a rod 18 to plate 14. As soon as board 14 is rocking, piston 17 is reciprocated in cylinder 15, and low-refrigerant is inhaled from an inhalation chamber 3 (inhalation pressure Ps) into cylinder 15. The refrigerant is then compressed in cylinder 15 by piston 17 and discharged with high-pressure (discharge pressure Pd) into a discharge chamber 4.

The inhaled refrigerant is supplied through an inhalation duct 1 from an evaporator (not shown) situated upstream of inhalation chamber 3. High-pressure refrigerant is discharged from discharge chamber 4 through a discharge duct 2 into a condenser (not shown) situated upstream of discharge chamber 4.

The inclination angle of plate 14 is changed according to the value of said control pressure Pc in crank chamber. The amount of discharged high pressure refrigerant (the capacity of the compressor 10) varies accordingly with the inclination angle of plate 14. Indirectly, the inhalation pressure Ps also varies in dependence from the inclination.

Said control pressure Pc in crank chamber 12 is automatically controlled by pressure control valve. Control pressure duct 5 connects crank chamber 12 to port 31. Inhalation branch duct 6 connects port 32 to inhalation duct 1. Control pressure duct 5 additionally and directly communicates with discharge duct 2 via a small leak passage 7.

In a condition where the value of electric current supplied to electromagnetic coil 21 is fixed, valve element 25 fulfils opening and closing movements according to variations of inhalation pressure Ps. As soon as inhalation pressure Ps is high enough, valve element 25 is lifted from valve seat 26 and control pressure Pc in crank chamber 12 at least essentially equals suction pressure Ps (maximum capacity). As soon as valve element 25 is seated on valve seat 26, since inhalation pressure PS is low, high-pressure refrigerant flows via leak passage 7 and duct 5 into chamber 30 and simultaneously into crank chamber 12. Control pressure Pc increases and the capacity of compressor 10 decreases corresponding. With decreasing capacity of the compressor 10 inhalation pressure Ps again increases, until valve element 25 again is lifted from valve seat 26.

The capacity of the compressor 10 is controlled at a certain control level determined by the value of the electric current supplied to electromagnetic coil 21. Said control level can be changed arbitrarily by varying the value of the electric current for electromagnetic coil 21.

The value of the electric current for coil 21 is controlled via a not shown driving circuit and by a control part 8 containing a CPU or the like. Control information for control part 8 are input in the form of detected signals from an engine sensor, temperature sensors inside and outside of the automobile compartment, an evaporator pressure and/or temperature sensor, and possibly other sensors detecting different kinds of conditions which are decisive for the operation of compressor 10 within the refrigerating cycle.

Diaphragm 24 of pressure control valve 20 in the capacity control apparatus of the compressor 10 has a much smaller pressure effective size than the diaphragms had to have in prior art apparatuses. In co-operation with a small size diaphragm it is possible to control the capacity of the compressor properly by using a small sized and cheap solenoid. Furthermore, it is not necessary to have a very small sized valve seat 26 in pressure control valve 20. Since valve seat 26 is of the same size as pressure effective area of diaphragm 24 a sufficiently strong refrigerant flow is achieved as soon as pressure control valve 20 opens. The control behavior thus is not delayed. The capacity control apparatus as described instead can be used for a rotary type compressor or a scroll type compressor.

What is claimed is:

1. A capacity control apparatus of a capacity variable compressor, the capacity of which varies essentially corresponding to variations of a control pressure as supplied into a pressure control chamber of said compressor, said compressor having an inhalation chamber and a discharge chamber, said capacity control apparatus comprising a pressure control valve having a chamber receiving an axially displaceable valve element co-acting with a valve seat which defines a flow passage between said inhalation chamber and said pressure control chamber of said compressor, and having a force transmitting diaphragm separating said chamber at its axial end opposite to said valve seat from ambient air pressure, and having valve element actuating means loading said valve element via said diaphragm in closing direction of said pressure control valve by a resilient force, the magnitude of which is selectively adjustable, said valve element when seated on said valve seat having a pressure effected area of a certain size, and said diaphragm having a pressure effected area of a certain size, wherein said chamber is connected to said pressure control chamber, wherein said valve seat is connected to said inhalation chamber outside said chamber, the sizes of said pressure effected areas being at least essentially equal, wherein an outer edge portion of said diaphragm is stationarily supported on a circular shoulder of a housing bore of said pressure control valve, said valve element carrying a frustoconical closure element for co-action with a circular inner edge of said valve seat, and wherein said circular shoulder has an inner diameter of essentially the same size as an inner diameter of said valve seat inner edge.

2. A capacity control apparatus of a capacity variable compressor, the capacity of which varies essentially corresponding to variations of a control pressure as supplied into a pressure control chamber of said compressor, said compressor having an inhalation chamber and a discharge chamber, said capacity control apparatus comprising a pressure control valve having a chamber receiving an axially displaceable valve element co-acting with a valve seat which defines a flow passage between said inhalation chamber and said pressure control chamber of said compressor, and having a force transmitting diaphragm separating said chamber at its axial end opposite to said valve seat from ambient air pressure, and having valve element actuating means loading said valve element via said diaphragm in closing direction of said pressure control valve by a resilient force, the magnitude of which is selectively adjustable, said valve element when seated on said valve seat having a pressure effected area of a certain size, and said diaphragm having a pressure effected area of a certain size, wherein said chamber is connected to said pressure control chamber, wherein said valve seat is connected to said inhalation chamber outside said chamber, the sizes of said pressure effected areas being at least essentially equal, wherein said valve element actuating means comprises a first compression spring biasing said valve element in closing direction, a second compression spring biasing said valve element in opening direction with a smaller force than said first compression spring is acting in closing direction, a moveable iron core transmitting the biasing force of said first compression spring to said valve element, said moveable iron core being attracted by a fixed iron core upon energisation of a magnetic coil and counter to the biasing force of said first compression spring, and said diaphragm secured in place between said moveable iron core and said valve element, said diaphragm being acted upon by the pressure within said chamber in opening direction of said valve element and by the pressure of ambient air and a resulting biasing force derived from said biasing force of said first compression spring and the attracting force for said moveable iron core, wherein said valve seat is formed by a rear end of a sleeve inserted into a front end portion of said chamber, and wherein said sleeve receives said second compressor spring and an axially adjustable adjust screw.

* * * * *

UNITED STATES PATENT AND TRADEMARK OFFICE

CERTIFICATE OF CORRECTION

PATENT NO. : 6,394,761 B1
DATED : May 28, 2002
INVENTOR(S) : Hisatoshi Hirota

It is certified that error appears in the above-identified patent and that said Letters Patent is hereby corrected as shown below:

Title page,
Item [73], Assignee: TGK Co., Inc., Tokyo (JP)" should read -- [73] Assignee: TGK Co., Ltd., Tokyo (JP) --

Signed and Sealed this

Twenty-third Day of July, 2002

*Attest:*

*Attesting Officer*

JAMES E. ROGAN
*Director of the United States Patent and Trademark Office*